United States Patent [19]

Clifford

[11] 4,337,096

[45] Jun. 29, 1982

[54] METHOD AND IMPLEMENT FOR CLEANING DRAINS

[75] Inventor: Jack R. Clifford, Alton, Ill.

[73] Assignees: Paul L. Pratt, Bethalto; John T. Pierce, Jr., Edwardsville, both of Ill. ; part interest to each

[21] Appl. No.: 205,645

[22] Filed: Nov. 10, 1980

Related U.S. Application Data

[63] Continuation-in-part of Ser. No. 168,727, Jul. 14, 1980, Pat. No. 4,326,893, which is a continuation-in-part of Ser. No. 42,548, May 25, 1979, Pat. No. 4,218,803.

[51] Int. Cl.[3] ..... B08B 9/04

[52] U.S. Cl. ..... 134/8; 134/24; 15/104.3 R

[58] Field of Search ..... 134/22.11, 22.12, 167 C, 134/8, 24; 15/104.05, 104.3 R

[56] References Cited

U.S. PATENT DOCUMENTS

| | | | |
|---|---|---|---|
| 494,427 | 3/1893 | LaCroix et al. | 15/104.3 R |
| 713,077 | 11/1902 | Dubois | 15/104.3 R |
| 1,972,402 | 9/1934 | Jones | 15/104.3 R |
| 2,201,680 | 5/1940 | Haynes | 15/104.3 R |
| 2,328,060 | 8/1943 | Crane et al. | 15/104.3 R |
| 3,600,223 | 8/1971 | Parmelee | 134/24 |

FOREIGN PATENT DOCUMENTS

| | | | |
|---|---|---|---|
| 1052742 | 1/1954 | France | 15/104.3 R |
| 32575 | 5/1968 | German Democratic Rep. | 15/104.3 R |

*Primary Examiner*—S. Leon Bashore, Jr.
*Assistant Examiner*—Michael L. Goldman
*Attorney, Agent, or Firm*—Grace J. Fishel

[57] ABSTRACT

An implement and method for cleaning sanitary, industrial or the like drains, said implement having a carriage hub with radially extending cutting means and a correspondingly radially extending plunger means, together with means for wetting the debris in the drain in advance of the cutting means, said plunger means comprising a plurality of fan shaped elements pivoted between said radially extending cutting means and which are folded backwardly when the implement is pulled forwards through a drain in a direction parallel to the axis of the hub and which are expanded into a plate when the implement is pulled backwards in an opposite direction. Depending on the configuration of the fan shaped elements, the implement is capable of cleaning drains of various configurations including box culverts and tubular pipes. When the radially extending cutting means are circular segments and the fan shaped elements are circular sectors, said implement preferably further including a circumferentially extending scraping means with transverse circumferentially extending knives affixed thereto.

10 Claims, 9 Drawing Figures

METHOD AND IMPLEMENT FOR CLEANING DRAINS

This application is a continuation-in-part of application Ser. No. 168,727, filed July 14, 1980 now U.S. Pat. No. 4,326,893 for Implement for Cleaning Tubular Drains, which is a continuation-in-part of application Ser. No. 42,548, filed May 25, 1979 for Implement for Cleaning Tubular Culverts, now U.S. Pat. No. 4,218,803.

The present invention relates to an improved implement for cleaning sanitary, industrial and other drains.

While the present invention may be utilized for cleaning box culverts or the like, it is particularly well adapted in its preferred embodiment for cleaning sanitary and industrial drains. Sanitary and industrial drains, unlike typical culverts, have bends. In time the pipes become clogged with sedimentation e.g., grease in sewers, calcium deposits in water pipes, rust in gas pipes, sludge in refinery pipes and so forth. Since at the present time there is no equipment for cleaning such pipes which can be simply passed through them, they are cleaned by isolating straight sections of the line, cutting the joints, running a piece of equipment between joints and then replacing the joints. Whether the pipe is buried in the ground or suspended from a platform in the air, there is a clear need for an implement which can be passed down through the pipe around the 45 or 90 degree bends normally encountered therein without taking the pipe apart.

In view of the above, among the several objects of the present invention may be noted the provision of an improved implement for cleaning drains of all configurations. In its preferred embodiment, it is an object of the present invention to provide an implement which is particularly well adapted for cleaning tubular sanitary and industrial drains and which can be passed down through the drain and can even negotiate compound 90 degree bends. Other objects and features will be in part apparent and in part pointed out hereinafter. The invention accordingly comprises the constructions hereinafter described, the scope of the invention being indicated in the subjoined claims.

In the accompanying drawings, in which two of various possible embodiments of the invention are illustrated, corresponding reference numerals refer to corresponding parts and in which.

Figure 1:
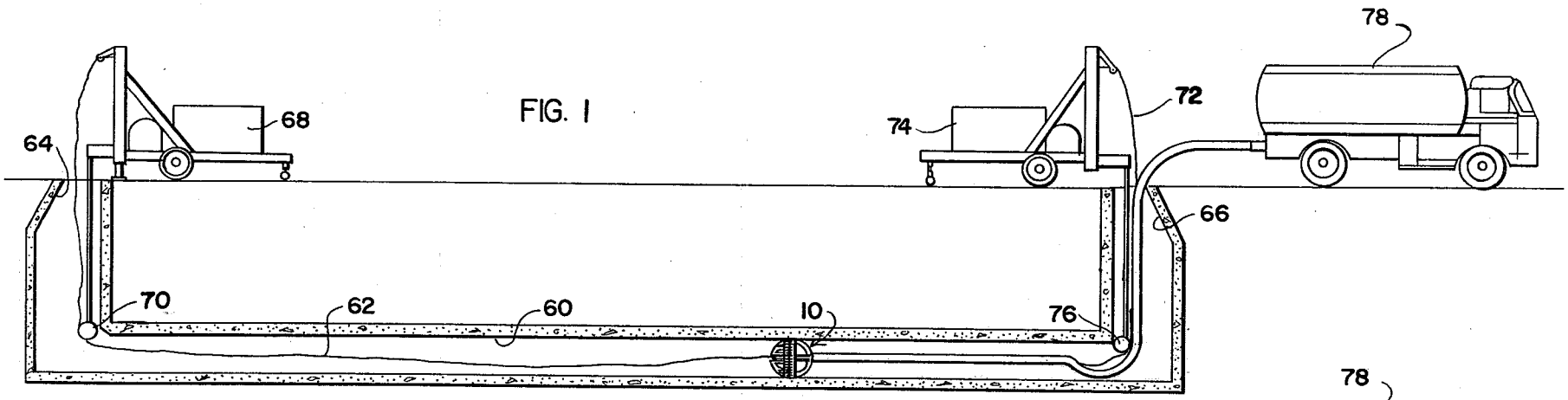
FIG. 1 is a vertical cross-sectional view of a sanitary sewer showing an improved implement in accordance with the present invention being pulled forward and with the plunger means folded into a fan.

Referring to FIGS. 1–7 more particularly by reference character, reference numeral 10 refers to an improved implement in accordance with the present invention. Implement 10 includes a carriage hub shown as assembly 12 with radially extending cutting means 14 and a correspondingly radially extending plunger means 16, together with circumferentially extending scraping means 18 and means for wetting the debris 20 in the drain.

Carriage assembly 12 includes a hollow pipe 22 which is capped at its forward end 24 and is tapped (not shown) adjacent its rearward end 26 for attachment to a hose coupling. Rearward end 26 of pipe 22 is outfitted with a pinion 28 with hitching means 30, best seen in FIG. 6, for attachment to a drag cable as more particularly described below. Carriage assembly 12 further includes a tow bar 32 with a hole adjacent its forward end for attachment to a drag cable. Tow bar 32 extends into pipe 22 and through end cap 24 and is bolted at 34 to effect transfer of the pulling force from the capped end of the pipe to carriage assembly 12 midway the leading and trailing edges of cutting means 14. Carriage assembly 12 further includes mounting means for cutting means 14 such as cradle flanges 36.

As illustrated in the drawings, cutting means 14 are made up of a plurality of radially projecting cutter blades 38 which are preferably symmetrically spaced around the outside of pipe 22 and are mounted parallel to the longitudinal axis thereof in cradle flanges 36 which are also mounted parallel to pipe 22. To provide for radial adjustment, different sized cutter blades 38 are provided and are detachably mounted to pipe 22 by means of the aforesaid cradle flanges 36. In the preferred embodiment shown in FIGS. 1–7 cutter blades 38 are circular segments which when mounted in cradle flanges 36 are inscribed within a sphere.

Figure 4:
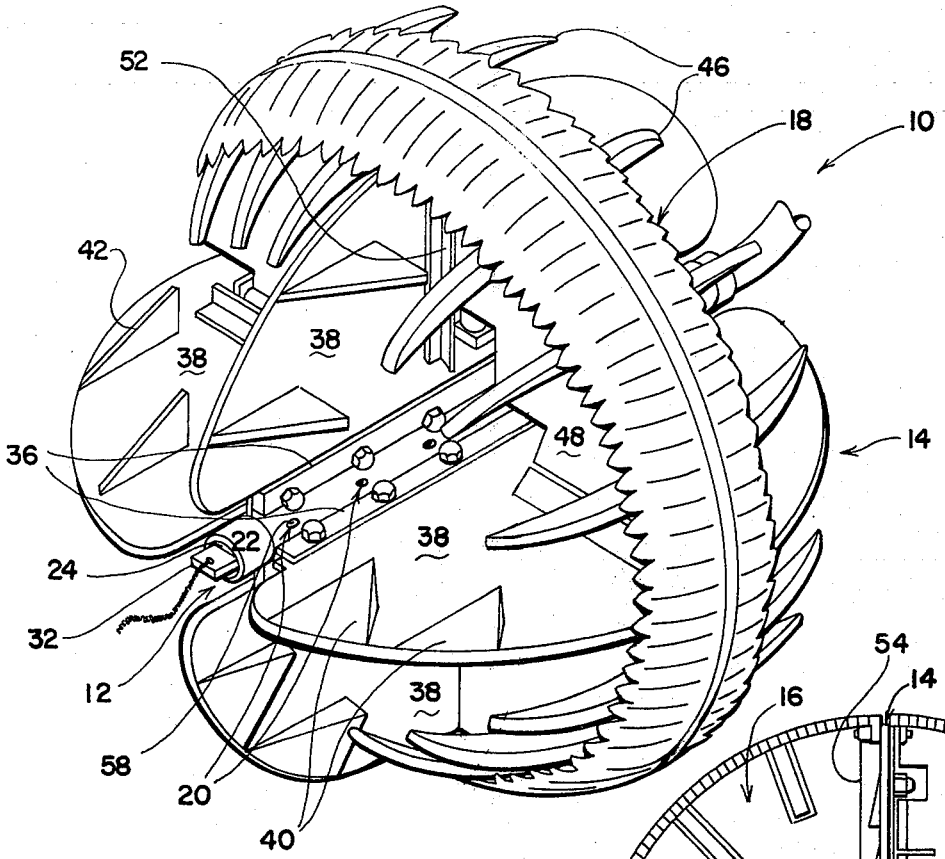
FIG. 4 is an enlarged perspective view of the implement shown in FIGS. 1–3.
Figure 5:
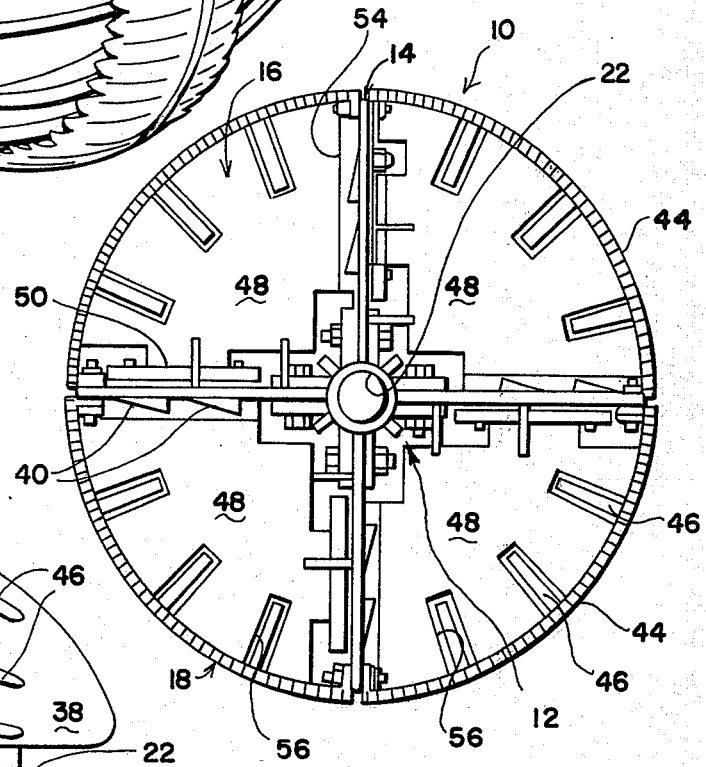
FIG. 5 is a cross-sectional view taken along line 5—5 in FIG. 6.
Figure 6:
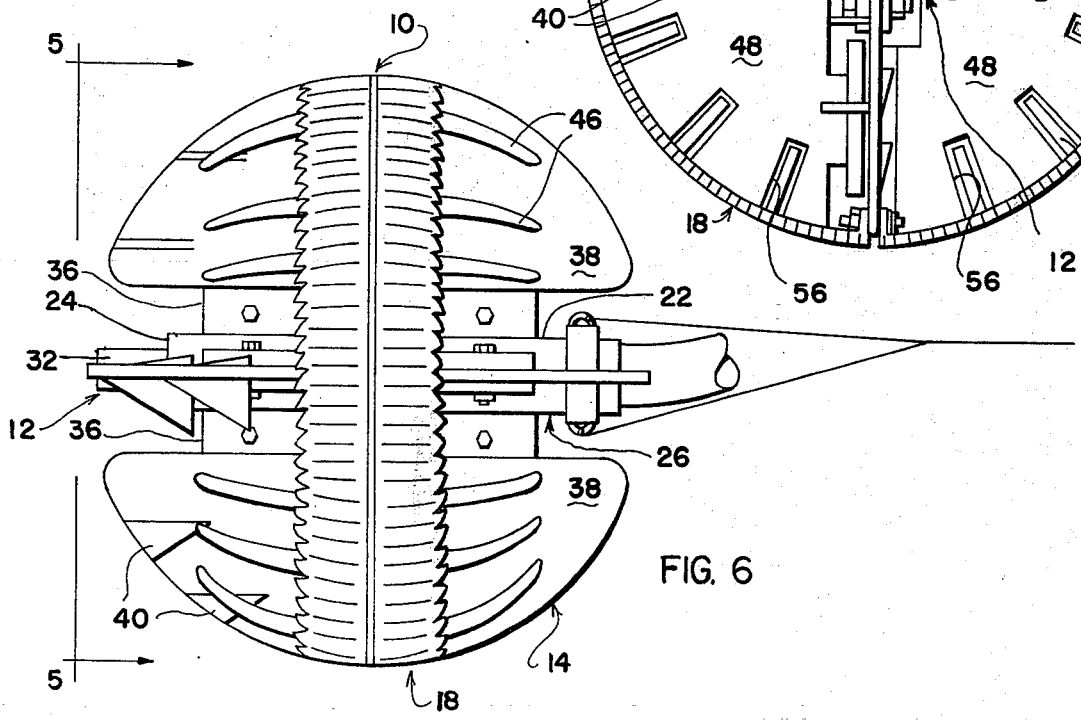
FIG. 6 is a side elevational view.

As best seen in FIGS. 4–6, a pair of spaced apart ax shaped wedges 40 and a pair of triangular stabilizer plates 42 are mounted on opposite sides of the leading edge of each of cutter blades 38. Wedges 40 are mounted flat side down against blades 38 and with their sharpened edges facing forwards and triangular plates 42 are mounted such that they point forward and are generally parallel to pipe 22 and at right angles to blades 38.

Figure 3:
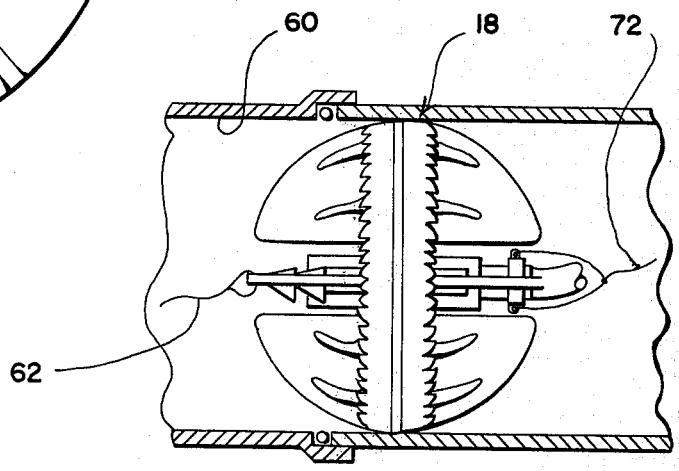
FIG. 3 is a fragmentary, cross-sectional view like FIG. 1 but showing the improved implement having passed over a joint in the drain and being pulled backward with the plunger means expanded into a plate.

A plurality of arcuate shaped plates 44 are mounted between each of blades 38 and make up circumferentially extending scraping means 18. As illustrated, opposite ends of arcuate plates 44 are flanged for attachment to cutter blades 38 and opposite side edges are preferably serrated or sharpened. To maintain the symmetry of the implement, arcuate plates 44 are preferably attached to plates 38 at midpoints thereof and adjacent their outer edges such that the scraping means are inscribed within the same sphere as cutting means 14. Attached to arcuate plates 44 are a plurality of double pointed arcuate knives 46, said knives 46 being affixed transverse to arcuate plates 44 and extending circumferentially part way around implement 10. Arcuate knives 46 are mounted such that their outer edges are coterminous with the sphere within which cutter blades 38 and arcuate plates 44 are inscribed. As more particularly described below knives 46 serve as runners which allow the implement to be towed over minor imperfections in the drain pipe as shown in FIG. 3. It is preferred that knives 46 extend only part way around the machine otherwise they form a cage which interferes with the flow of debris through the machine. To this end, knives 46 are preferably only as long as necessary to serve as rockers when the machine is rocked 45 degrees as this is the maximum possible off-center pull even when the machine is rounding a 90 degree bend. For the reasons set forth above, it is preferred that the knives be no longer than necessary.

Figure 7:
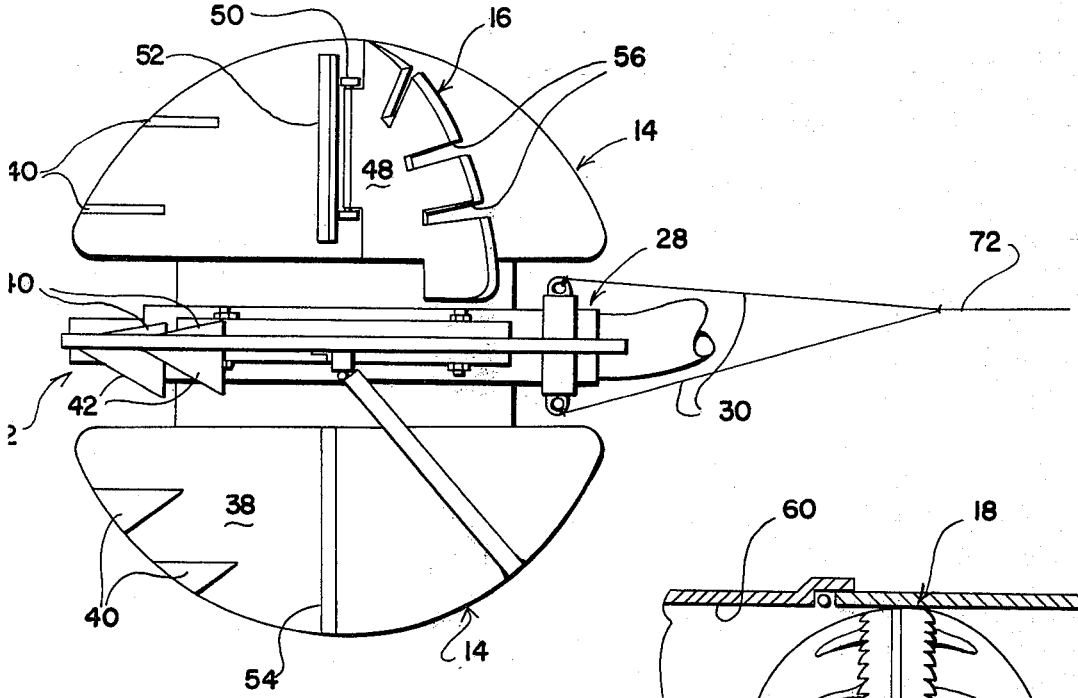
FIG. 7 is a side elevational view like FIG. 6 but with the circumferentially extending scraping means removed.

Plunging means 16 include a plurality of fan shaped elements 48 pivoted between radially extending cutter blades 38. In the embodiment shown in FIGS. 1–7, elements 48 are pivoted to cutter blades 38 on hinges 50. To provide symmetry to the implement, elements 48 are attached to cutter blades 38 midway between their leading and trailing ends. As best seen in FIG. 7, a deflector plate 52 is mounted parallel to each of hinges 50 and in advance thereof such that debris passing around elements 48 is deflected away from the hinges as the implement is towed forward. With continuing reference to FIG. 7, it is seen that elements 48 close against a flange 54 correspondingly mounted on an adjacent cutter blade 38 and forming a stop.

Figure 2:
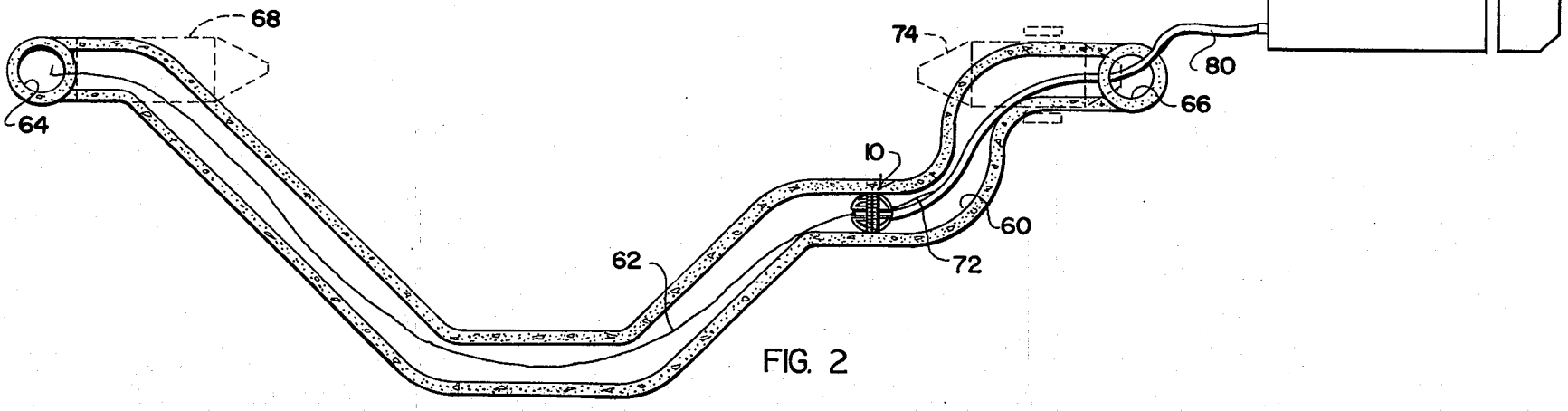
FIG. 2 is a horizontal cross-sectional view like FIG. 1.

As shown in FIGS. 1–2, when implement 10 is pulled forwards in a drain in a direction parallel to the axis of hub 12, elements 48 are folded backwardly into a fan opening outwardly from front to back. Whereas the implement 10 is pulled backwardly in an opposite direction, elements 48 are expanded into a plate by pivoting on hinges 50 and closing against flanges 54. As best seen in FIG. 5, there are four fan shaped elements 48 pivoted between a corresponding number of radially extending cutter blades 38. If more elements 48 and cutter blades 38 are used, plunging means 16 can be folded into a fan having a smaller base thus offering less resistance when the implement is towed forward. Correspondingly, fewer elements 48 give rise to a plunging means which folds into a fan which opens up into a larger base offering more resistance. To accommodate the motion of elements 48 by knives 46, radial slots 56 are formed in elements 48 such that knives 46 do not obstruct the closing of elements 48 against flanges 54.

In the form illustrated in FIGS. 1–7, water directing means 58 comprise a plurality of water jets, preferably located in spaced apart sets between blades 38 along the length of pipe 22 and in front and to the rear of plunging means 16. As best seen in FIG. 4, in the embodiment illustrated therein, water directing means 58 is made up of 12 forward jets (shown) on the barrel of pipe 22, all of which may or may not be used in any one particular job. Eight additional jets (not shown) are located behind plunging means 16 and are set at 45 degrees towards the rear of implement 10. The forward jets are provided as four sets of two spaced apart jets located in front of plunging means 16 and set at 45 degrees towards plunging means 16 to direct the debris backwardly thereto. Four further forward jets are located adjacent end cap 24 and are set at 90 degrees with two additional jets formed in the end cap. If desired, the water directing means 58 can be located in cutter blades 38 if blades 38 are appropriately channelized.

As illustrated in FIGS. 1–3, implement 10 can be used to clean a drain such as sanitary sewer 60 wherein the outside diameter of the cutting means 14, the circumferentially extending scraping means 18 and the fully expanded plunging means 16 fit within close tolerances therein. For example, a 7-inch diameter implement would be suitable for cleaning an 8-inch drain and so forth. A first cable 62 is threaded through the drain. When the drain is between manholes 64 and 66 as illustrated in FIGS. 1 and 2, this operation is advantageously accomplished by means of a high pressure jet nozzle which is propelled by a backwards jet action through the drain.

After cable 62 is threaaded through the drain, one end of it is hooked on a swivel in the aforementioned hole in tow bar 32 while the other end is attached to a means for pulling the implement through the drain such as winch 68. To keep the direction of pull on cable 62 on centerline with the drain, cable 62 is preferably passed around a roller 72 which is anchored near the bottom of manhole 64 by means of an adjustable rod attached to winch 68. A second cable 72 is attached to hitching means 30 by means of a pair of shackles joined by a loop of cable for draging the implement out backwards with a second means for pulling such as winch 74. As with cable 62, cable 72 is passed around a roller 76 which like roller 70 is anchored near the bottom of manhole 66 by means of an adjustable rod attached to winch 74. A source of water under high pressure such as water truck 78 is attached by means of a flexible hole 80 to implement 10 at the aforementioned hose coupling.

As shown in FIGS. 1 and 2, with water spraying out of selected water directing means 58 for slurrying the waste, implement 10 is towed forwards in a direction parallel to the axis of carriage assembly 12 by winch 68. As the water is sprayed, circumferentially extending scraping means 18 scrape the debris from the walls of the drain and cutting means 14 churn the debris and direct it backwardly towards plunging means 16 where the weight of the debris folds fan shaped elements 48 backwardly into a fan, the wide end of which opens out in a direction opposite to that in which the implement is being towed. Any tree roots or other obstructions are cut loose by scraping means 18 and torn up by cutting means 14. The implement is torqued by the debris as it flows past ax shaped wedges 40 and folded fan elements 48. If an imperfection is encountered in drain 60, implement 10 will rock and slide over it on knives 46 which keep the sharpened edges of arcuate plates 44 from catching on the imperfection. The joint shown in FIG. 3 is ideally smooth and, as will be readily appreciated, in reality the joints are often much misaligned because the pipe has settled. It is important that arcuate plates 44 not catch on the joints or on other imperfections because, if they do, there is a chance that they might split the pipe. The chance of this happening is particularly great with old sewer pipes which are not vitrified and are quite soft.

When a selected amount of material has been churned loose and passed rearward through the implement the direction of travel is reversed as shown in FIG. 3 and winch 74 is used to tow implement 10 backwards. As implement 10 moves backwardly, the open ends of the fan formed by the folded fan shaped elements 48 become filled with debris exerting pressure on elements 48, which causes them to fold forward until stopped by flanges 54. A number of stops (not shown) can be mounted on cutter blades 38 to prevent elements 48 from folding flat against blades 38.

When implement 10 is towed backwardly by winch 74, water from water directing means 58 grease the passage of the implement through the drain. As the implement is towed backwardly, the slurried waste behind the implement is drawn into manhole 66 by plunger means 16 where it wells up. A vacuum water or sludge truck, shown as combination water supply and pumper truck 78, provides means for pumping the liquefied waste from manhole 66 by which it is removed from the system but other means can be used for pumping the waste such as a clam bucket or auger system. When implement 10 has returned to the mouth of sewer 60, the direction of pull is reversed. This back-and-forth motion is continued until the drain is cleaned.

Figure 8:
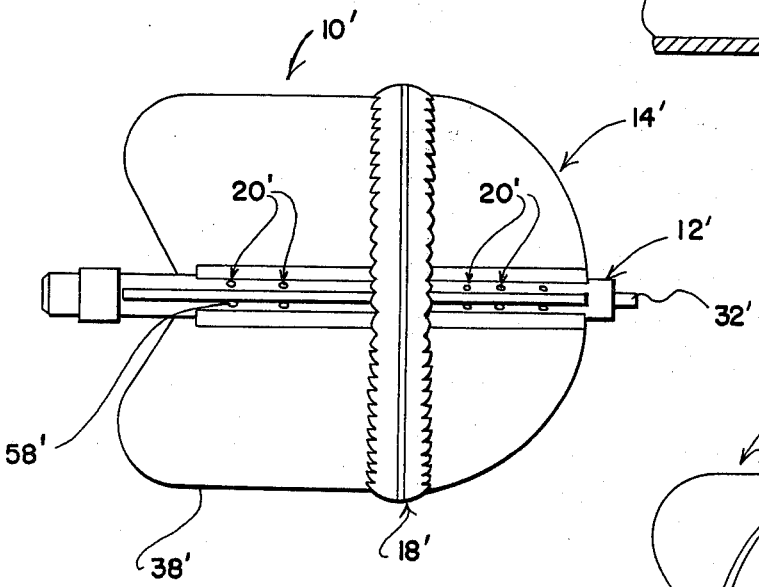
FIG. 8 is a side elevational view of a second implement in accordance with the present invention; and, FIG. 9 is a horizontal cross-sectional view of the implement shown in FIG. 8.
Figure 9:
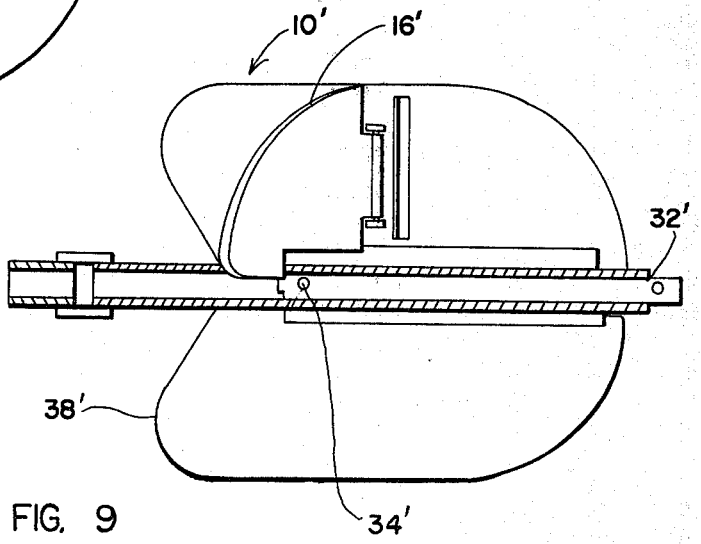

For some applications as shown in FIGS. 8 and 9, cutter blades 38' are rounded only on the forward end. If desired, windows (not shown) can be cut in each cutter blade 38' to lighten the overall weight of the implement and to allow the debris to flow between adjacent blades. Other parts of implement 10' find their counterpart in corresponding parts of implement 10.

In view of the above, it will be seen that the several objects of the invention are achieved and other advantageous results attained. As various changes could be made in the above constructions and methods without departing from the scope of the invention it is intended that all matter contained in the above description or shown in the accompanying drawings shall be interpreted as illustrative and not in a limiting sense.

What is claimed is:

1. An implement for cleaning drains, said implement comprising a carriage hub for attachment of cutting and plunging means, said cutting means comprising a plurality of blades radially extending from the carriage hub, said plunging means comprising a plurality of elements pivoted between said blades and prevented from folding flat against said blades so that said elements are folded backward at an inclined angle to said blades when the implement is pulled through a drain in a direction parallel to the hub whereby said inclined elements are arranged to torque the implement and which are folded forwardly to form a plate when the implement is pulled in an opposite direction, said implement further including water directing means for spraying water in advance of the cutting means.

2. The implement of claim 1 wherein the fully expanded plunging means substantially fills the drain.

3. An implement for cleaning drains, said implement comprising a carriage hub with cutting, plunging and scraping means, said cutting means comprising a plurality of blades radially extending from the carriage hub, said blades being circular segments and mounted on said carriage hub such that said implement is spherical in shape, said plunging means comprising a plurality of elements pivoted between said blades and prevented from folding flat against said blades so that said elements are folded backwardly at an inclined angle to said blades when the implement is pulled through a drain in one direction parallel to the hub whereby said inclined elements are arranged to torque the implement and which are folded forwardly to form a plate when the implement is pulled in an opposite direction, said scraping means comprising a ring normal to the carriage hub and encircling said blades, said implement further including water directing means for spraying water in advance of the cutting means.

4. The implement of claim 3 wherein said plunging means comprise a plurality of fan shaped elements pivoted to said radially extending blades, said fan shaped elements being circular sections and mounted on said blades such that when the fan shaped elements are folded forwardly into a plate substantially normal to the axis of the carriage hub the fan shaped elements substantially fill the drain.

5. The implement of claim 4 wherein the scraping means include a plurality of spaced apart, transverse circumferentially extending knives.

6. The implement of claim 5 wherein the radially extending blades are detachably mounted on said carriage hub.

7. The implement of claim 6 including stops against which the fan shaped elements are closed and which provide auxiliary support when the plunging means are expanded into a plate.

8. The implement of claim 7 wherein the fan shaped elements have radial slots which are in alignment with the circumferentially extending knives so that the knives pass through said elements when they are folded forwardly to form a plate.

9. A method for cleaning tubular drains filled with debris which comprises towing an implement comprising a carriage hub with cutting, plunging and scraping means, said cutting means comprising a plurality of blades radially extending from the carriage hub, said blades being circular segments and mounted on said carriage hub such that said implement is spherical in shape, said plunging means comprising a plurality of elements pivoted between said blades and prevented from folding flat against said blades so that said elements are folded backwardly at an inclined angle to said blades when the implement is pulled forward through a drain in a direction parallel to the axis of the carriage hub whereby said inclined elements torque the implement, said pulling being in a forward direction and for a selected distance, said implement further including water directing means for spraying water in front of the cutting means whereby the waste in the drain is wetted by water from the water directing means, churned loose by the cutting means and passed around the plunging means torquing the implement; said method further including towing the implement in an opposite direction after the preselected distance has been reached, as said implement is towed backwardly, the loosened waste material in the drain exerting pressure on one or more of said pivoted elements comprising the plunging means and inclined at an angle to said blades causing them to reverse the fold into a plate having substantially the same diameter as the drain, whereby the waste churned loose by the cutting means and passed around the plunging means is swept backward by the fully expanded plunging means as the implement is towed backwards.

10. The method of claim 9 which further includes pumping slurried waste from the tubular drain as said implement is towed backwards.

* * * * *